US006560924B1

(12) United States Patent
Weder et al.

(10) Patent No.: US 6,560,924 B1
(45) Date of Patent: May 13, 2003

(54) METHOD OF COVERING A POT OR FLORAL GROUPING WITH A SLEEVE HAVING A TRIANGULAR LOWER END

(75) Inventors: Donald E. Weder, Highland, IL (US); Joseph G. Straeter, Highland, IL (US); Paul Fantz, Imperial, MO (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/941,995

(22) Filed: Aug. 29, 2001

Related U.S. Application Data

(63) Continuation-in-part of application No. 09/549,646, filed on Apr. 14, 2000, now Pat. No. 6,298,601, which is a continuation of application No. 09/238,327, filed on Jan. 27, 1999, now abandoned, which is a continuation of application No. 08/606,957, filed on Feb. 26, 1996, now abandoned.

(51) Int. Cl.[7] ..... A47G 7/08
(52) U.S. Cl. ..... 47/72
(58) Field of Search ..... 47/72, 41.01; 206/423

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,044,260 | A | 11/1912 | Schloss | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,794,212 | A | 2/1931 | Snyder | |
| 1,811,574 | A | 6/1931 | Barrett | |
| 1,863,216 | A | 6/1932 | Wordingham | |
| 1,978,631 | A | 10/1934 | Herrlinger | 91/68 |
| 2,048,123 | A | 7/1936 | Howard | 229/87 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 345464 | 12/1921 |
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |

(List continued on next page.)

OTHER PUBLICATIONS

Speed Cover Brochure, "The Simple Solution For Those Peak Volume Periods", Highland Supply Corporation, ©1989.

"Speed Sheets and Speed Rolls" Brochure, Highland Supply Corporation, ©1990.

"Color Them Happy with Highlander Products" ©1992.

"Costa Keeps the Christmas Spirit", Supermarket Floral, Sep. 15, 1992.

"Super Seller", Supermarket Floral, Sep. 15, 1992.

(List continued on next page.)

*Primary Examiner*—Charles T. Jordan
*Assistant Examiner*—Jeffrey L. Gellner
(74) *Attorney, Agent, or Firm*—Dunlap, Codding & Rogers, P.C.

(57) ABSTRACT

A tubular sleeve having a triangular lower end for covering a pot or floral grouping. The sleeve may have a detachable upper portion and may have a non-linear or linear upper edge.

40 Claims, 5 Drawing Sheets

U.S. PATENT DOCUMENTS

| | | | | | |
|---|---|---|---|---|---|
| RE21,065 | E | | 5/1939 | Copeman | 93/2 |
| 2,170,147 | A | | 8/1939 | Lane | 206/56 |
| 2,200,111 | A | | 5/1940 | Bensel | 229/1.5 |
| 2,278,673 | A | | 4/1942 | Savada et al. | 154/43 |
| 2,302,259 | A | | 11/1942 | Rothfuss | 41/10 |
| 2,323,287 | A | | 7/1943 | Amberg | 229/53 |
| 2,355,559 | A | | 8/1944 | Renner | 229/8 |
| 2,371,985 | A | | 3/1945 | Freiberg | 206/46 |
| 2,411,328 | A | | 11/1946 | MacNab | 33/12 |
| 2,510,120 | A | | 6/1950 | Leander | 117/122 |
| 2,529,060 | A | | 11/1950 | Trillich | 117/68.5 |
| 2,621,142 | A | | 12/1952 | Wetherell | 154/117 |
| 2,648,487 | A | | 8/1953 | Linda | 229/55 |
| 2,688,354 | A | | 9/1954 | Berger | 150/28 |
| 2,774,187 | A | | 12/1956 | Smithers | 47/41 |
| 2,822,287 | A | | 2/1958 | Avery | 117/14 |
| 2,846,060 | A | | 8/1958 | Yount | 206/58 |
| 2,850,842 | A | | 9/1958 | Eubank, Jr. | 47/58 |
| 2,883,262 | A | | 4/1959 | Borin | 21/56 |
| 2,989,828 | A | | 6/1961 | Warp | 53/390 |
| 3,022,605 | A | | 2/1962 | Reynolds | 47/58 |
| 3,080,680 | A | | 3/1963 | Reynolds | 47/37 |
| 3,094,810 | A | | 6/1963 | Kalpin | 47/37 |
| 3,121,647 | A | | 2/1964 | Harris et al. | 118/202 |
| 3,130,113 | A | | 4/1964 | Silman | 161/97 |
| 3,271,922 | A | | 9/1966 | Wallerstein et al. | 53/3 |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,431,706 | A | | 3/1969 | Stuck | 53/390 |
| 3,508,372 | A | | 4/1970 | Wallerstein et al. | 53/3 |
| 3,510,054 | A | | 5/1970 | Sanni et al. | 229/66 |
| 3,512,700 | A | | 5/1970 | Evans et al. | 229/53 |
| 3,550,318 | A | | 12/1970 | Remke et al. | 47/37 |
| 3,550,662 | A | * | 12/1970 | Remke | 383/107 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,557,516 | A | | 1/1971 | Brandt | 53/14 |
| 3,620,366 | A | | 11/1971 | Parkinson | 206/59 |
| 3,681,105 | A | | 8/1972 | Milutin | 117/15 |
| 3,767,104 | A | | 10/1973 | Bachman et al. | 229/7 |
| 3,793,799 | A | | 2/1974 | Howe | 53/32 |
| 3,861,279 | A | * | 1/1975 | Maling | 428/16 |
| 3,869,828 | A | | 3/1975 | Matsumoto | 47/34.11 |
| 3,888,443 | A | | 6/1975 | Flanigen | 248/152 |
| 3,962,503 | A | | 6/1976 | Crawford | 428/40 |
| 4,014,252 | A | * | 3/1977 | Saito | 493/217 |
| 4,043,077 | A | | 8/1977 | Stonehocker | 47/66 |
| 4,054,697 | A | | 10/1977 | Reed et al. | 428/40 |
| 4,091,925 | A | | 5/1978 | Griffo et al. | 206/423 |
| 4,113,100 | A | | 9/1978 | Soja et al. | 206/602 |
| 4,118,890 | A | | 10/1978 | Shore | 47/28 |
| 4,189,868 | A | | 2/1980 | Tymchuck et al. | 47/84 |
| 4,216,620 | A | | 8/1980 | Weder et al. | 47/72 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,280,314 | A | | 7/1981 | Stuck | 53/241 |
| 4,297,811 | A | | 11/1981 | Weder | 47/72 |
| 4,333,267 | A | | 6/1982 | Witte | 47/84 |
| 4,347,686 | A | | 9/1982 | Wood | 47/73 |
| 4,380,564 | A | | 4/1983 | Cancio et al. | 428/167 |
| 4,400,910 | A | | 8/1983 | Koudstall et al. | 47/84 |
| 4,413,725 | A | | 11/1983 | Bruno et al. | 206/45.33 |
| D279,279 | S | | 6/1985 | Wagner | D11/143 |
| 4,526,565 | A | * | 7/1985 | Hummel et al. | 383/104 |
| 4,546,875 | A | | 10/1985 | Zweber | 206/82 |
| 4,621,733 | A | | 11/1986 | Harris | 206/423 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,765,464 | A | | 8/1988 | Ristvedt | 206/82 |
| 4,771,573 | A | | 9/1988 | Stengel | 47/67 |
| 4,773,182 | A | | 9/1988 | Weder et al. | 47/72 |
| 4,801,014 | A | | 1/1989 | Meadows | 206/423 |
| 4,810,109 | A | | 3/1989 | Castel | 383/105 |
| 4,835,834 | A | | 6/1989 | Weder | 29/525 |
| D301,991 | S | | 7/1989 | Van Sant | D11/149 |
| 4,941,572 | A | | 7/1990 | Harris | 206/423 |
| 4,980,209 | A | | 12/1990 | Hill | 428/34.1 |
| 4,989,396 | A | | 2/1991 | Weder et al. | 53/397 |
| D315,700 | S | | 3/1991 | Stephens | D11/151 |
| 5,073,161 | A | | 12/1991 | Weder et al. | 493/154 |
| 5,074,675 | A | | 12/1991 | Osgood | 383/122 |
| 5,105,599 | A | | 4/1992 | Weder | 53/399 |
| 5,111,638 | A | | 5/1992 | Weder | 53/397 |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwalder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | | 8/1993 | Landau | 47/72 |
| 5,239,775 | A | | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | | 5/1994 | Weder | 53/410 |
| 5,315,785 | A | | 5/1994 | Avôt et al. | 47/72 |
| 5,350,240 | A | | 9/1994 | Billman et al. | 383/104 |
| 5,353,575 | A | | 10/1994 | Stepanek | 53/461 |
| 5,361,482 | A | | 11/1994 | Weder et al. | 29/469 |
| 5,381,642 | A | * | 1/1995 | Weder et al. | 229/87.01 |
| 5,388,695 | A | | 2/1995 | Gilbert | 206/423 |
| 5,428,939 | A | | 7/1995 | Weder et al. | 53/397 |
| 5,443,670 | A | | 8/1995 | Landau | 156/191 |
| 5,493,809 | A | | 2/1996 | Weder et al. | 47/72 |
| D368,025 | S | | 3/1996 | Sekerak et al. | D9/305 |
| 5,496,251 | A | | 3/1996 | Cheng | 493/224 |
| 5,496,252 | A | | 3/1996 | Gilbert | 493/224 |
| 5,526,932 | A | | 6/1996 | Weder | 206/423 |
| 5,551,570 | A | | 9/1996 | Shaffer et al. | 206/575 |
| 5,572,849 | A | | 11/1996 | Weder et al. | 53/399 |
| 5,572,851 | A | | 11/1996 | Weder | 53/399 |
| 5,575,133 | A | | 11/1996 | Weder et al. | 53/397 |
| 5,617,703 | A | | 4/1997 | Weder | 53/413 |
| 5,624,320 | A | | 4/1997 | Martinez | 472/51 |
| 5,625,979 | A | | 5/1997 | Weder | |
| 5,647,168 | A | | 7/1997 | Gilbert | 47/72 |
| 5,647,193 | A | | 7/1997 | Weder et al. | 53/465 |
| 5,715,944 | A | | 2/1998 | Windisch | 206/423 |
| D404,684 | S | | 1/1999 | Shea | D11/164 |
| 5,974,730 | A | | 11/1999 | Chien | 47/41.01 |
| D419,436 | S | | 1/2000 | Celtorius et al. | D9/305 |
| 6,129,209 | A | | 10/2000 | Tchira | 206/423 |
| 6,453,611 | B1 | * | 9/2002 | Weder et al. | 47/72 |

FOREIGN PATENT DOCUMENTS

| | | | |
|---|---|---|---|
| DE | 3601207 | A1 * | 7/1987 |
| DE | 3829281 | | 5/1989 |
| DE | 3911847 | | 10/1990 |
| EP | 0050990 | | 5/1982 |
| EP | 0791543 | | 8/1997 |
| FR | 1376047 | | 9/1964 |
| FR | 2036163 | | 12/1970 |
| FR | 2137325 | | 12/1972 |
| FR | 2272914 | | 12/1975 |
| FR | 2489126 | | 3/1982 |
| FR | 2610604 | | 8/1988 |
| FR | 2603159 | | 3/1989 |

| | | | |
|---|---|---|---|
| FR | 2619698 | | 3/1989 |
| GB | 5605 | | 5/1885 |
| GB | 1204647 | | 9/1970 |
| GB | 2056410 | | 3/1981 |
| GB | 2074542 | | 11/1981 |
| GB | 2128083 | | 4/1984 |
| GB | 2252708 | | 8/1992 |
| IT | 224507 | | 4/1996 |
| JP | 542958 | | 2/1993 |
| JP | 8-295349 | * | 1/1996 |
| JP | 2000-210038 | * | 8/2000 |
| JP | 2000-257131 | * | 9/2000 |
| NL | 8301709 | | 12/1984 |
| NL | 1000658 | | 1/1996 |
| WO | 9315979 | | 8/1993 |

OTHER PUBLICATIONS

"Halloween", Link Magazine, Sep. 1992.

"Now More Than Ever", Supermarket Floral, Sep. 15, 1992.

Le Plant Sac Advertisement, published prior to Sep. 26, 1987.

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Stand Alone Plastic Bagmaking" brochure, AMI, Atlanta, GA, Feb. 15, 1996, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

"Creative Packaging" Brochure, John Henry Company, Sep. 1992.

"Make Highlander Your Headquarters" Brochure, Highland Supply Corporation, 1991.

* cited by examiner

METHOD OF COVERING A POT OR FLORAL GROUPING WITH A SLEEVE HAVING A TRIANGULAR LOWER END

CROSS REFERENCE TO RELATED APPLICATIONS

The present application is a continuation-in-part of U.S. Ser. No. 09/549,646, filed Apr. 14, 2000, now U.S. Pat. No. 6,298,601, which is a continuation of Ser. No. 09/238,327, filed Jan. 27, 1999, now abandoned, which is a continuation of Ser. No. 08/606,957, filed Feb. 26, 1996, now abandoned.

FIELD OF THE INVENTION

This invention generally relates to sleeves, and more particularly, to sleeves used to wrap floral groupings or flower pots containing floral groupings and/or mediums containing floral groupings, and methods of using same.

DESCRIPTION OF THE PREFERRED EMBODIMENTS

Figure 1:
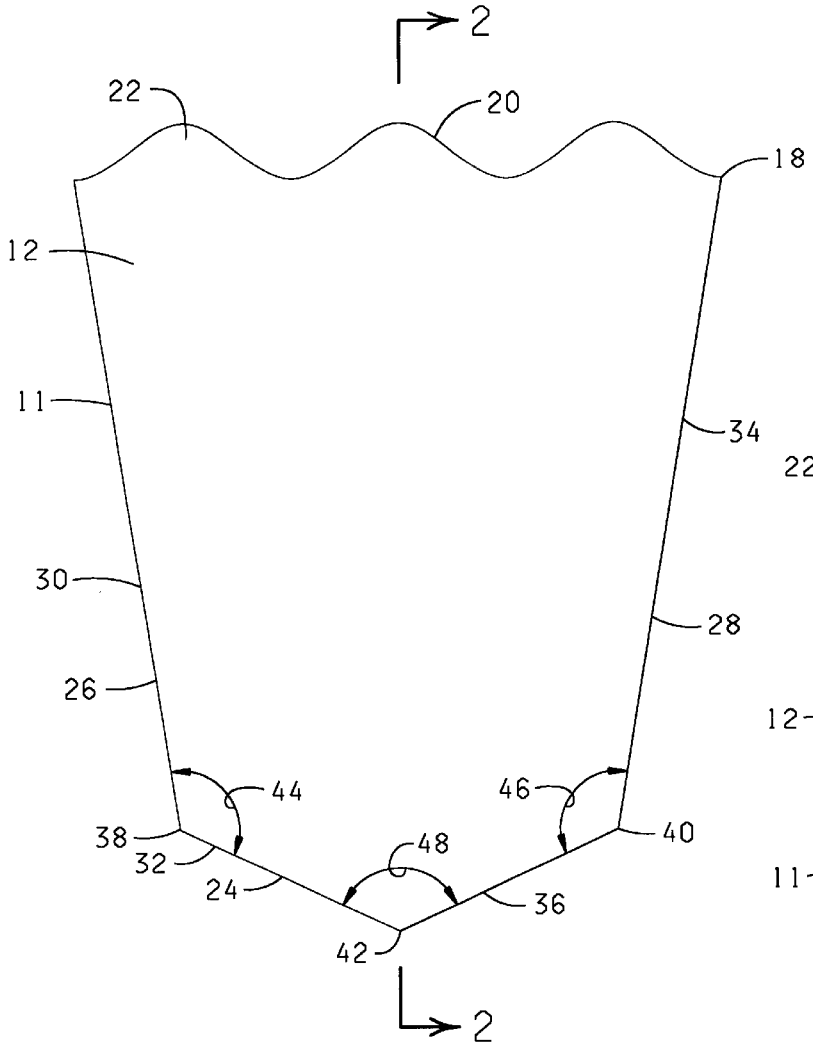
FIG. 1 is an elevational view of a sleeve constructed in accordance with the present invention.

The present invention contemplates in a preferred version a tubular sleeve (also referred to herein simply as a "sleeve") which is sized to contain a flower pot with a floral grouping, or a floral grouping alone or a floral grouping with a growing medium. The tubular sleeve has a triangular lower end when in a flattened condition. The tubular sleeve may further comprise a detachable upper portion which may be sized to surround and encompass a floral grouping disposed in a flower pot.

A lower portion of the tubular sleeve may be constructed from a first material and an upper portion (where present) may be constructed from the first material or a second material different from the first material.

Various embodiments of the tubular sleeve having the triangular lower end are now described in more detail below. It will be understood that the examples provided herein are not intended to limit the scope and extent of the claimed invention but are only intended to exemplify various embodiments of the invention contemplated herein.

Turning now to the drawings, shown in FIGS. 1–4 is a sleeve designated by the general reference numeral 10.

Sleeve 10 has a body 11 having an outer peripheral surface 12, an inner peripheral surface 14, an inner space 16, an upper end 18, an upper edge 20 in the upper end 18, optionally a skirt portion 22, and a triangular lower end 24. The sleeve 10 may be individually sized so that a floral grouping, floral bouquet, or a standard sized flower pot, such as a 3-inch, 3½-inch, 4-inch, 4½-inch, 5-inch-, 5½-inch, 6-inch, 6½-inch, 7-inch or 8-inch pot, for example, can fit within the inner space 16 of the body 11 of the sleeve 10. The body 11 of the sleeve 10 preferably has a tapered, frusto-conical shape. The triangular lower end 24 has a triangular shape as explained in further detail below. The sleeve 10 is initially formed in a flattened condition and is openable therefrom to an opened state for containing a pot floral container, or a floral grouping as described herein.

The body 11 of the sleeve 10 in the flattened condition has a first sidewall edge 26 and a second sidewall edge 28. The first sidewall edge 26 has an upper segment 30 and a lower segment 32. The second sidewall edge 28 has an upper segment 34 and a lower segment 36. The first sidewall edge 26 has a first vertex 38 where the upper segment 30 and lower segment 32 converge. The second sidewall edge 28 has a second vertex 40 where the upper segment 34 and the lower segment 36 converge. The triangular lower end 24 has a terminal vertex 42 where the lower segment 32 converges with the lower segment 36. The first vertex 38 has a first vertex angle 44 which faces inwardly and preferably has an angular dimension greater than 100° and less than 165°. The second vertex 40 has a second vertex angle 46 which faces inwardly, is opposite the first vertex angle 44, and has an angular dimension preferably greater than 100° and less than 165°. The terminal vertex 42 has a terminal vertex angle 48 which faces inwardly towards the upper end 18 and has an angular dimension which is preferably greater than 30° and less than 160°. Together the first vertex 38, the second vertex 40, the terminal vertex 42, the lower segment 32 and the lower segment 36 form the triangular lower end 24.

Figure 2:
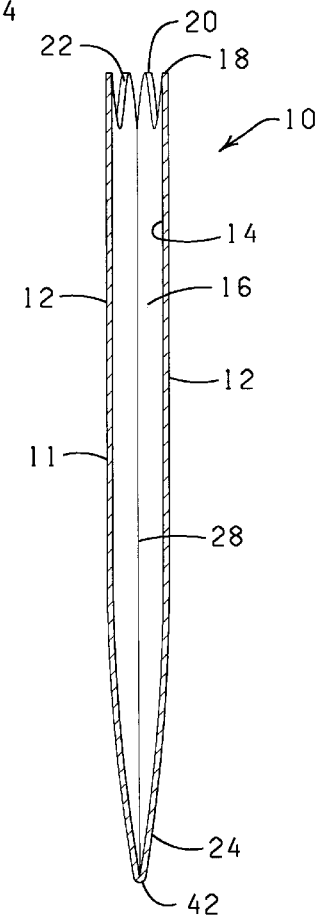
FIG. 2 is a cross-sectional view of the sleeve of FIG. 1 taken along line 2—2.

In a preferred version of the invention as shown in FIGS. 1 and 2, the upper edge 20 of the upper end 18 has a non-linear shape which forms the skirt portion 22. Other non-linear configurations of upper edge 20 such as arcuate, and others such as those shown in FIGS. 2A–2F of U.S. Pat. No. 5,829,225, the entire specification of which is hereby expressly incorporated herein by reference, will be readily apparent to those of ordinary skill in the art.

Each of the first vertex angle 44 and the second vertex angle 46 may have an angular dimension greater than about 105° and less than about 160°. Alternatively, each of the first vertex angle 44 and the second vertex angle 46 may be between about 110° and 155°. Further, each of the first vertex angle 44 and the second vertex angle 46 may be between about 115° and 150°. Alternatively, each of the first vertex angle 44 and the second vertex angle 46 may be between about 120° and 145°. Further, each of the first vertex angle 44 and the second vertex angle 46 may be between about 125° and 140°. Alternatively, each of the first vertex angle 44 and the second vertex angle 46 may be between about 130° and 135°.

The terminal vertex angle 48 may have an angular dimension greater than about 35° and less than about 155°, greater than about 40° and less than about 150°, greater than about 45° and less than about 145°, greater than 55° and less than about 130°, greater than about 60° and less than about 120°, greater than about 70° and less than about 110°, greater than about 80° and less than about 105°, greater than about 85° and less than about 100°, or greater than about 90° and less than about 95°.

Figure 3:
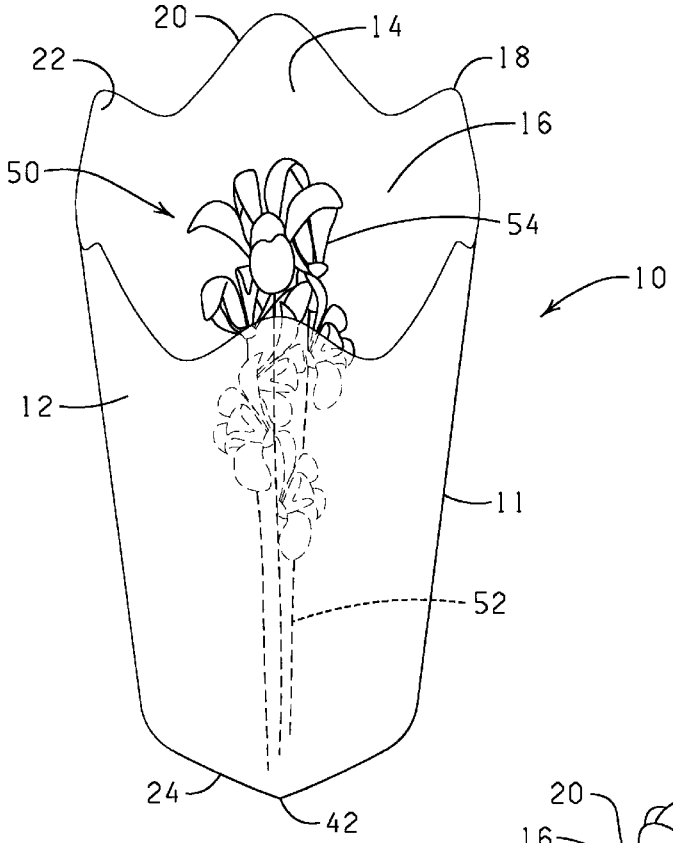
FIG. 3 is a perspective view of the sleeve of FIG. 1 having a floral grouping disposed therein.
Figure 4:
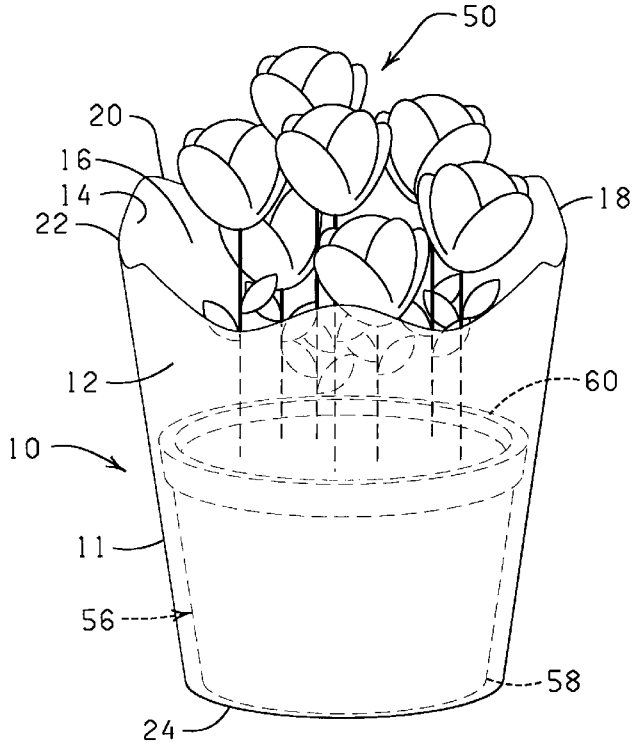
FIG. 4 is a perspective view of the sleeve of FIG. 1 having a potted plant therein.

Shown in FIG. 3 is the sleeve 10 in an opened condition and having a floral grouping 50 contained therein. Floral grouping 50 preferably has a stem portion 52 and a bloom portion 54. Shown in FIG. 4 is the sleeve 10 in an opened condition and having a pot 56 disposed in the inner space 16 of the body 11. The pot 56 may be any pot as described hereinabove and in a preferred embodiment has a floral grouping 50 disposed therein. Pot 50 also has a lower end 58 and an upper end 60. Any of the sleeves shown herein may be used in a manner similar to sleeve 10 to cover a floral grouping 50 or pot 56.

Figure 5:
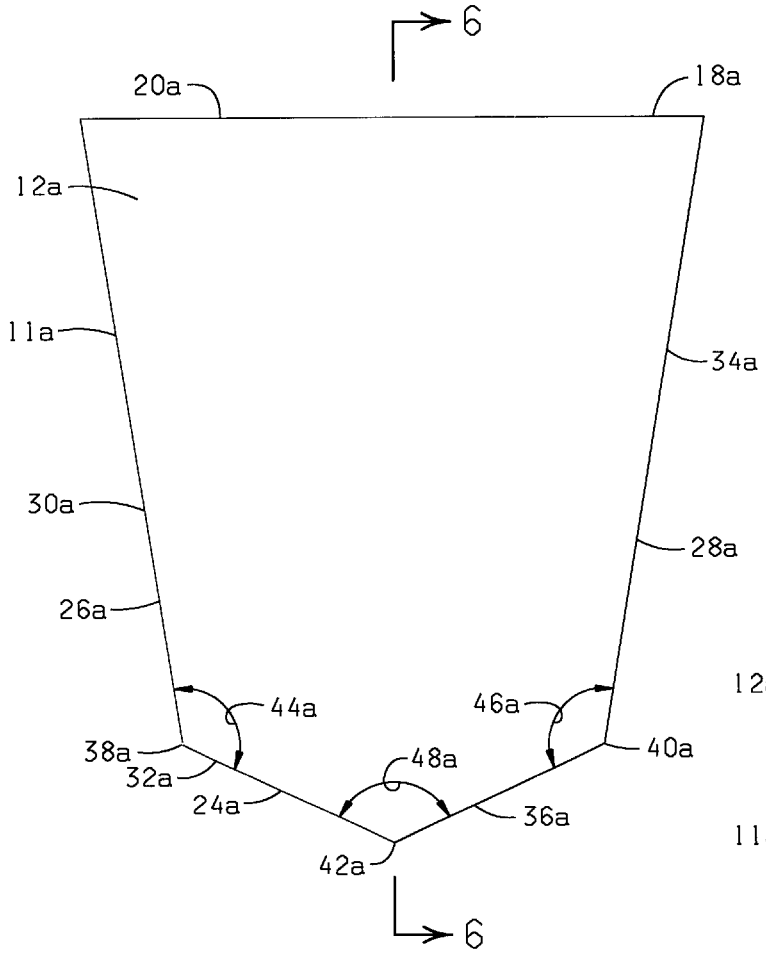
FIG. 5 is an elevational view of another sleeve constructed in accordance with the present invention.
Figure 6:
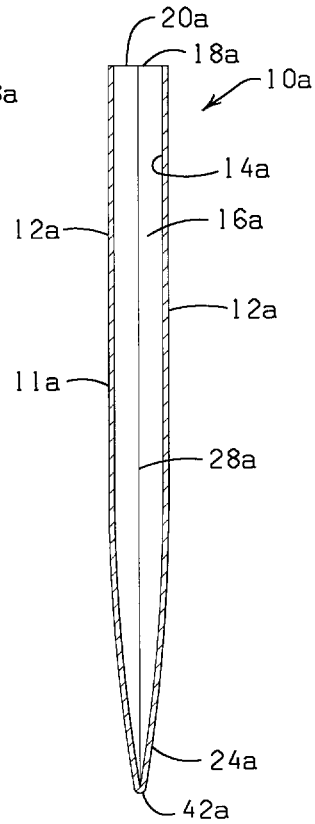
FIG. 6 is a cross-sectional view of the sleeve of FIG. 5 taken along line 6—6.

Shown in FIGS. 5 and 6 is a sleeve designated by the general reference numeral 10*a*. Sleeve 10*a* is similar to sleeve 10 and has a body 11*a*, an outer peripheral surface 12*a*, an inner peripheral surface 14*a*, an inner space 16*a*, and upper end 18*a*, an upper edge 20*a* on the upper end 18*a*, a triangular lower end 24*a*, a first sidewall edge 26*a* having an upper segment 30*a* and a lower segment 32*a*, a second sidewall edge 28*a* having an upper segment 34*a* and a lower segment 36*a*, a first vertex 38*a* between the upper segment 30*a* and the lower segment 32*a*, a second vertex 40*a*, between the upper segment 34*a* and the lower segment 36*a*, a terminal vertex 42*a* at the junction of the lower segment 32*a* and the lower segment 36*a*, the first vertex 38*a* having a first vertex angle 44*a*, the second vertex 40*a* having a second vertex angle 46*a*, and the terminal vertex 42*a* having a terminal vertex angle 48*a*.

First vertex angle 44*a* may have an angular dimension similar to the angular dimension of first vertex angle 44. Second vertex angle 46*a* may have an angular dimension similar to the angular dimension of second vertex angle 46. Terminal vertex angle 48*a* may have an angular dimension similar to the angular dimension of terminal vertex angle 48.

Sleeve 10*a* differs from sleeve 10 primarily in that sleeve 10*a* has an upper edge 20*a* which is generally horizontal in the flattened condition, or which is slightly arcuate and corresponds to the upper end 60 of the pot 56 when the pot 56 is disposed within the sleeve 10*a*. Sleeve 10*a* therefore lacks a portion which corresponds to the skirt portion 24 of sleeve 10. Sleeve 10*a* is otherwise similar to sleeve 10.

Figure 7:
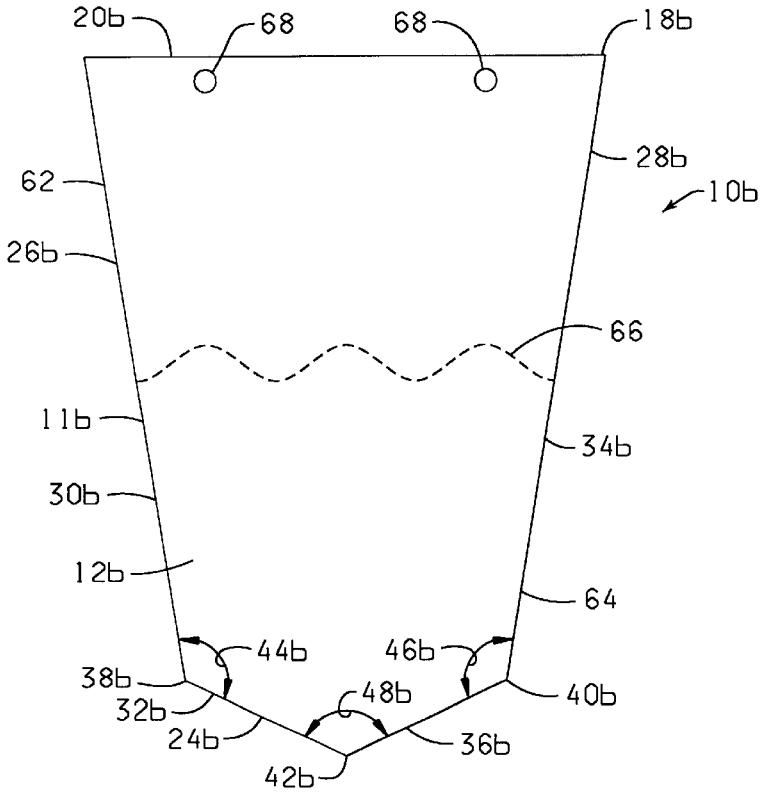
FIG. 7 is an elevational view of another embodiment of a sleeve constructed in accordance with the present invention.

Shown in FIG. 7 is a sleeve designated by the general reference numeral 10*b*. Sleeve 10*b* is similar to sleeve 10 and has a body 11*b*, an outer peripheral surface 12*b*, an inner peripheral surface (not shown), an inner space (not shown), and upper end 18*b*, an upper edge 20*b* on the upper end 18*b*, a triangular lower end 24*b*, a first sidewall edge 26*b* having an upper segment 30*b* and a lower segment 32*b*, a second sidewall edge 28*b* having an upper segment 34*b* and a lower segment 36*b*, a first vertex 38*b* between the upper segment 30*b* and the lower segment 32*b*, a second vertex 40*b*, between the upper segment 34*b* and the lower segment 36*b*, a terminal vertex 42*b* at the junction of the lower segment 32*b* and the lower segment 36*b*, the first vertex 38*b* having a first vertex angle 44*b*, the second vertex 40*b* having a second vertex angle 46*b*, and the terminal vertex 42*b* having a terminal vertex angle 48*b*.

First vertex angle 44*b* may have an angular dimension similar to the angular dimension of first vertex angle 44. Second vertex angle 46*b* may have an angular dimension similar to the angular dimension of second vertex angle 46. Terminal vertex angle 48*b* may have an angular dimension similar to the angular dimension of terminal vertex angle 48.

Sleeve 10*b* differs from sleeve 10 primarily in that the body 11*b* of sleeve 10*b* has an upper portion 62 which is detachable from a lower portion 64 via a detaching element 66 which preferably is a line of perforations having a non-linear pattern. Sleeve 10*b* also has apertures 68 in the upper portion 62 for enabling the sleeve 10*b* to be supported from a support assembly such as a wicket (not shown). The lower portion 64 is generally sized to fit and contain the pot 56 while the upper portion 62 is generally sized to fit and contain the floral grouping 50 disposed within the pot 56. When the upper portion 62 is detached from the lower portion 64 via the detaching element 66, the lower portion 64 is left with a non-linear upper edge similar to the upper edge 20 of sleeve 10, and may have any non-linear shape, such as arcuate, curved, irregular, or wavy, as described for sleeve 10 previously.

Figure 8:
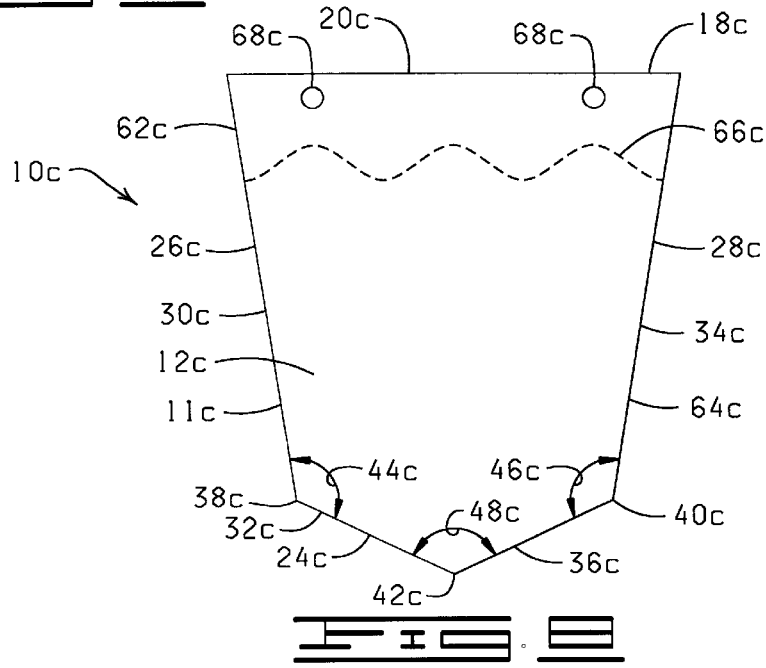
FIG. 8 is an elevational view of another embodiment of a sleeve constructed in accordance with the present invention.

Shown in FIG. 8 is a sleeve designated by the general reference numeral 10*c*. Sleeve 10*c* is similar to sleeve 10 and has a body 11*c*, an outer peripheral surface 12*c*, an inner peripheral surface (not shown), an inner space (not shown), and upper end 18*c*, an upper edge 20*c* on the upper end 18*c*, a triangular lower end 24*c*, a first sidewall edge 26*c* having an upper segment 30*c* and a lower segment 32*c*, a second sidewall edge 28*c* having an upper segment 34*c* and a lower segment 36*c*, a first vertex 38*c* between the upper segment 30*c* and the lower segment 32*c*, a second vertex 40*c*, between the upper segment 34*c* and the lower segment 36*c*, a terminal vertex 42*c* at the junction of the lower segment 32*c* and the lower segment 36*c*, the first vertex 38*c* having a first vertex angle. 44*c*, the second vertex 40*c* having a second vertex angle 46*c*, and the terminal vertex 42*c* having a terminal vertex angle 48*c*.

First vertex angle 44*c* may have an angular dimension similar to the angular dimension of first vertex angle 44. Second vertex angle 46*c* may, have an angular dimension similar to the angular dimension of second vertex angle 46. Terminal vertex angle 48*c* may have an angular dimension similar to the angular dimension of terminal vertex angle 48.

Sleeve 10*c* is similar to sleeve 10*b* primarily in that it has an upper portion 62*c* which is detachable from a lower portion 64*d* via a detaching element 66*c*, such as perforations, and has apertures 68*c* for enabling the sleeve 10*c* to be supported from a support assembly such as a wicket (not shown). Sleeve 10*c* differs from sleeve 10*b* in that the upper portion 62*c* is not sized to substantially surround and enclose the floral grouping 50 but is primarily intended to hold the sleeve 10*c* on a support assembly, (not shown) via apertures 68*c* and to be detached from the support assembly when sleeve 10*c* is torn therefrom, before the sleeve 10*c* is used to cover the floral grouping 50 or pot 56 having the floral grouping 50 therein.

Figure 9:
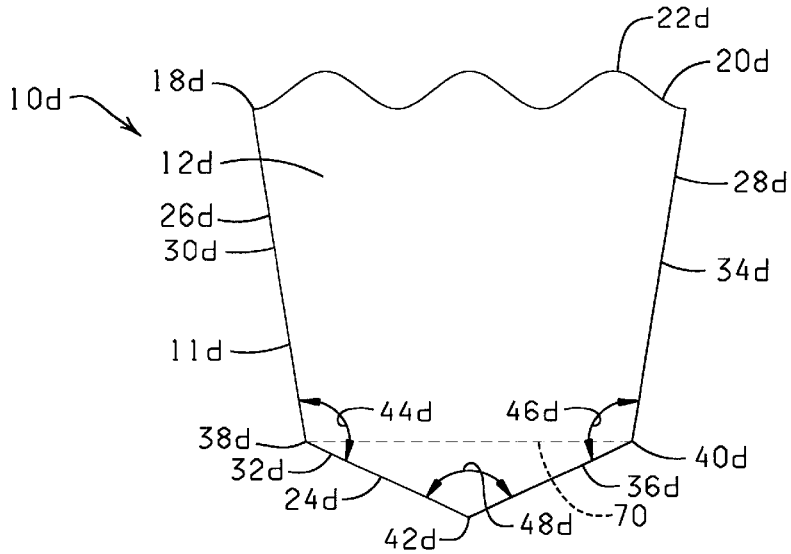
FIG. 9 is an elevational view of another embodiment of a sleeve constructed in accordance with the present invention.

Shown in FIG. 9 is a sleeve designated by the general reference numeral 10*d*. Sleeve 10*d* is similar to sleeve 10 and has a body 11*d*, an outer peripheral surface 12*d*, an inner peripheral surface (not shown), an inner space (not shown), and upper end 18*d*, an upper edge 20*d* on the upper end 18*d*, a skirt portion 22*d*, a triangular lower end 24*d*, a first sidewall edge 26*d* having an upper segment 30*d* and a lower segment 32*d*, a second sidewall edge 28*d* having an upper segment 34*d* and a lower segment 36*d*, a first vertex 38*d* between the upper segment 30*d* and the lower segment 32*d*, a second vertex 40*d*, between the upper segment 34*d* and the lower segment 36*d*, a terminal vertex 42*d* between the junction of the lower segment 32*d* and the lower segment 36*d*, the first vertex 38*d* having a first vertex angle 44*d*, the second vertex 40*d* having a second vertex angle 46*d*, and the terminal vertex 42*d* having a terminal vertex angle 48*d*.

First vertex angle 44*d* may have an angular dimension similar to the angular dimension of first vertex angle 44. Second vertex angle 46*d* may have an angular dimension similar to the angular dimension of second vertex angle 46. Terminal vertex angle 48*d* may have an angular dimension similar to the angular dimension of terminal vertex angle 48.

Sleeve 10*d* differs from sleeve 10 in that the triangular lower end 24*d* has a gusset 70 therein for enabling additional expansion of the triangular lower end 24*d* in the opened position for conforming to or containing the pot 56 or floral grouping 50. Any of the sleeves described herein may be modified to include a gusset 70 therein. Gussets and their construction are well known in the art therefore further discussion of their methods of construction is not deemed necessary herein.

Figure 10:
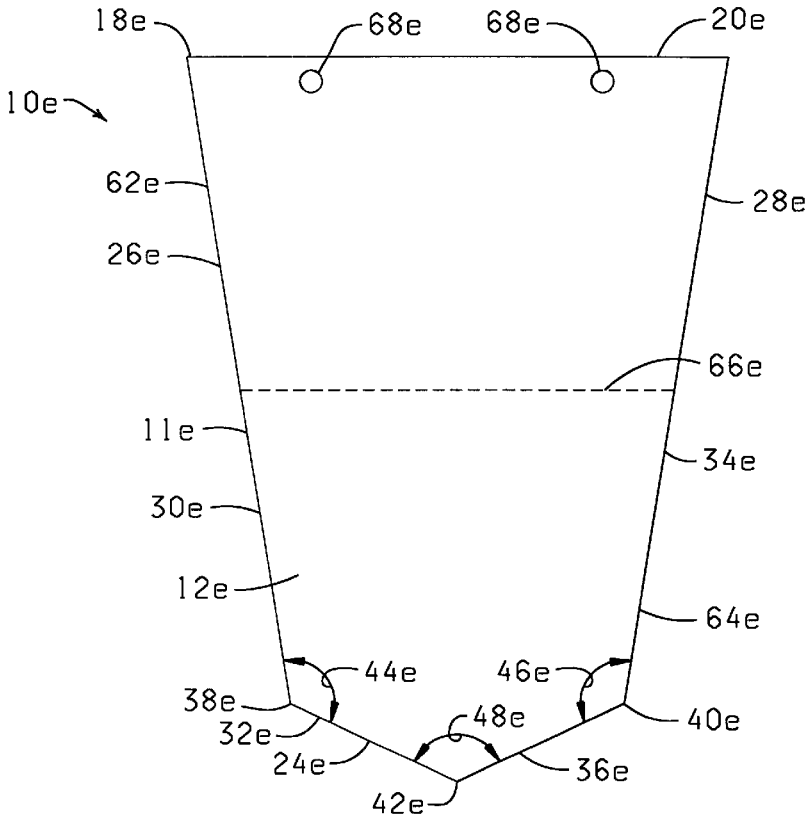
FIG. 10 is an elevational view of another embodiment of a sleeve constructed in accordance with the present invention.

Shown in FIG. 10 is a sleeve designated by the general reference numeral 10*e*. Sleeve 10*e* is similar to sleeve 10 and has a body 11*e*, an outer peripheral surface 12*e*, an inner peripheral surface (not shown), an inner space (not shown), and upper end 18*e*, an upper edge 20*e* on the upper end 18*e*, a triangular lower end 24*e*, a first sidewall edge 26*e* having an upper segment 30*e* and a lower segment 32*e*, a second sidewall edge 28*e* having an upper segment 34*e* and a lower segment 36*e*, a first vertex 38*e* between the upper segment 30*e* and the lower segment 32*e*, a second vertex 40*e*, between the upper segment 34*e* and the lower segment 36*e*, a terminal vertex 42*e* at the junction of the lower segment 32*e* and the lower segment 36*e*, the first vertex 38*e* having a first vertex angle 44*e*, the second vertex 40*e* having a second vertex angle 46*e*, and the terminal vertex 42*e* having a terminal vertex angle 48*e*.

First vertex angle 44*e* may have an angular dimension similar to the angular dimension of first vertex angle 44. Second vertex angle 46*e* may have an angular dimension similar to the angular dimension of second vertex angle 46. Terminal vertex angle 48*e* may have an angular dimension similar to the angular dimension of terminal vertex angle 48.

Sleeve 10*e* has an upper portion 62*e*, a lower portion 64*e* which is detachable from the upper portion 62*e* via a detaching element 66*e*, and apertures 68*e* in the upper portion 62*e* for enabling the sleeve 10*e* to be supported by a support assembly. Sleeve 10*e* is similar to sleeve 10*b* but differs in that the detaching element 66*e* is substantially horizontal in the flattened condition of the sleeve 10*e* rather than non-linear as shown in the detaching element 66*b* of sleeve 10*b*. When the upper portion 62*e* is detached, the lower portion 64*e* appears similar to sleeve 10*a*.

Any of the sleeves 10–10*e* contemplated herein may also be equipped with drainage elements (e.g., one or more holes) or ventilation holes (not shown), or can be made from permeable or impermeable materials.

Any thickness of material may be utilized to construct sleeves 10–10*e* as long as the sleeves 10–10*e* may be formed as described herein, and as long as the formed sleeves 10–10*e* may contain at least a portion of the pot 56 or floral grouping 50, as described herein. Additionally, an insulating material such as bubble film, preferable as one of two or more layers, can be utilized in order to provide additional protection for the item, such as the floral grouping 50, contained therein.

The material from which the sleeves 10–10*e* described herein are constructed preferably has a thickness in a range from about 0.1 mil to about 30 mils. Often, the thicknesses of the sleeves 10–10*e* are in a range from about 0.5 mil to about 10 mils or preferably, in a range from about 1.0 mil to about 5 mils. More preferably, the sleeves 10–10*e* are constructed from a material which is flexible, semi-rigid, rigid, or any combination thereof. The sleeves 10–10*e* may be constructed of a single layer of material or a plurality of layers of the same or different types of materials. The layers of material comprising the sleeves 10–10*e* may be connected together or laminated or may be separate layers. Such materials used to construct the sleeves 10–10*e* are similar to those described in U.S. Pat. No. 5,111,637, which is hereby expressly incorporated herein by reference.

The sleeves 10–10*e* are constructed from any suitable material that is capable of being formed into a sleeve and wrapped about a pot and/or a floral grouping disposed therein. Preferably, the material comprises treated or untreated paper, metal foil, polymeric film, non-polymeric film, woven or nonwoven fabric, or synthetic or natural fabric, cardboard, fiber, cloth, burlap, or laminations or combinations thereof.

In one embodiment, the.sleeves 10–10*e* contemplated herein may be constructed from sheets comprising two polypropylene films. The two polypropylene films comprising the sleeves 10–10*e* may be connected together or laminated or may be separate layers. In an alternative embodiment, the sleeves 10–10*e* may be constructed from only one sheet of the polypropylene film.

The term "polymeric film" means a synthetic polymer such as a polypropylene or a naturally occurring polymer such as cellophane. A polymer film is relatively strong and not as subject to tearing (substantially non-tearable), as might be the case with paper or foil.

The materials comprising the sleeves 10–10*e* may vary in color and as described herein may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination and may be applied to the outer and/or inner peripheral surface of the sleeves 10–10*e*. Moreover, portions of the material used in constructing the sleeves 10–10*e* may vary in the combination of such characteristics. The material utilized for the sleeves 10–10*e* may be opaque, translucent, transparent, or partially clear or tinted transparent.

The term "floral grouping" as used herein generally means cut fresh flowers, artificial flowers, a single flower or other fresh and/or artificial plants or other floral materials and may include other secondary plants and/or ornamentation or artificial or natural materials which add to the aesthetics of the overall "floral grouping". The floral grouping 50 comprises, as noted above, a bloom (or foliage) portion 54 and a stem portion 52. Further, the floral grouping 50 may comprise a root portion (not shown) as well. It will be appreciated that the floral grouping 50 may consist of only a single bloom or only foliage, or a botanical item (not shown), or a propagule (not shown). The term "floral grouping" may be used interchangeably herein with the term "floral arrangement".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" may be used interchangeably with the term "floral grouping", and when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping.

The term "propagule" when used herein means any structure capable of being propagated or acting as an agent of reproduction including seeds, shoots, stems, runners, tubers, plants, leaves, roots, or spores.

In accordance with the present invention a bonding material (not shown) may optionally be disposed on a portion of any of the sleeves 10–10*e* described herein to attach each sleeve 10–10*e* to the pot 56 having the floral grouping 50 therein when the pot 56 is disposed within the sleeve 10–10*e* or to assist in closing or sealing a portion of the sleeve 10–10*e*or in adhering the sleeve 10–10*e* to the pot 56 after the pot 56 has been disposed therein. Examples of how a bonding material may be disposed on the sleeve are shown in U.S. Pat. Nos. 5,493,809 and 5,625,979, both of which are hereby expressly incorporated herein by reference in their entirety.

The bonding material may alternatively be a band, tie, string, ribbon, wire, tape, heat shrinkable material, or other tying or banding device which may be constructed within or attached to the sleeve 10—10 before it is applied about the pot or floral grouping or may be provided only after the sleeve 10—10 is applied about the pot or floral grouping.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The detaching elements described herein may further have an additional substantial vertically disposed detaching element comprising a plurality of vertical perforations (not shown) for facilitating removal of an upper portion.

As indicated above, it will be understood by a person of ordinary skill in the art that equipment and devices for forming sleeves are commercially available, and are well known to a person of ordinary skill in the art. Further detailed discussion of the construction of the sleeves 10–10*e* described herein therefore is not deemed necessary. However, briefly, the sleeves 10–10*e* described herein may be formed by intermittently advancing two separate webs, one or two webs preformed in the form of a tube, or a single web folded double and sealing the longitudinal sides and bottom of the two facing panels then cutting the sleeve 10–10*e* thus formed from the webs or web. Machines which can form sleeves from such single webs or pairs of webs are well within the knowledge of one of ordinary skill in the art.

As noted above, any of the sleeves 10–10*e* contemplated herein may have an open or closed triangular lower end 24–24*e*. When the triangular lower end 24–24*e* is closed, the triangular lower end 24–24*e* may have one or more gussets as described elsewhere herein formed therein for allowing expansion of the triangular lower end 24–24*e* when an object with a broad lower end such as the pot 56 is disposed therein. In another version, any of sleeves 10–10*e* described herein may comprise a flap (not shown) which can be folded over and sealed with a bonding material to close the sleeve 10–10*e*.

The term "pot" as used herein refers to any type of container used for holding a floral grouping or plant, including vases. Examples of pots, used in accordance with the present invention include, but not by way of limitation, clay pots, wooden pots, foam pots, plastic pots, pots made from natural and/or synthetic fibers, and/or any combination thereof. The pot is adapted to receive a floral grouping in the retaining space thereof. The floral grouping may be disposed within the pot along with a suitable growing medium described elsewhere herein, or other retaining medium, such as a floral foam. It will also be understood that the floral grouping, and any appropriate growing medium or other retaining medium, may be disposed in the sleeve without a flower pot for cultivating the floral grouping or displaying a grown floral grouping.

It should also be noted that for all modified versions of sleeves 10–10*e* described above which have an adhesive or cohesive bonding material thereon, it may be desirable to have a release material or cover strip covering the adhesive or cohesive bonding material disposed on any portion of the sleeve 10–10*e* for preventing the bonding material from bonding to another surface until desired. Further, in each of the cases described herein wherein a sleeve 10–10*e* is applied to the pot 56, the sleeve 10–10*e* may be applied thereto either by depositing the pot 56 downwardly into the open sleeve 10–10*e*, or the sleeve 10–10*e* may be brought upwardly about the pot 56 from below the pot 56.

It should be further noted that various features of the versions of the present invention such as closure bonding areas, support apertures, handles or handle apertures, additional perforations, drainage elements, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A method of covering a pot or floral grouping, comprising:

providing a sleeve initially constructed in a flattened condition, the sleeve comprising:

a body having an upper end, a triangular lower end, a first sidewall edge, and an inner space, the sleeve in the flattened condition having a terminal vertex in the triangular lower end at a junction of the first sidewall edge and the second sidewall edge, and the terminal vertex having a terminal vertex angle which faces inwardly and has an angular dimension greater than about 30° and less than about 160°, and a portion of the first sidewall edge having a first vertex, the first vertex having a first vertex angle which faces inwardly and has an angular dimension greater than about 100° and less than about 165°, and a portion of the second sidewall edge having a second vertex, the second vertex having a second vertex angle which faces the first vertex angle and has an angular dimension greater than about 100° and less than about 165°, and wherein a lower segment of the first sidewall edge, a lower segment of the second sidewall edge, the first vertex, the second vertex, and the terminal vertex cooperate to define the triangular lower end, and the body of the sleeve having a generally tapered shape when in an opened condition and the triangular lower end having an openable gusset therein;

opening the sleeve to expose the inner space of the body; and disposing a pot or floral grouping into the inner space.

2. The method of claim 1 wherein in the step of providing a sleeve, the sleeve further comprises a skirt portion in the upper end of the body.

3. The method of claim 1 wherein in the step of providing a sleeve, the upper end of the body of the sleeve has a non-linear upper edge.

4. The method of claim 1 wherein in the step of providing a sleeve, the upper end of the body of the sleeve has a linear upper edge.

5. The method of claim 1 wherein in the step of providing a sleeve, the first vertex angle and the second vertex angle are between about 105° and about 160°.

6. The method of claim 1 wherein in the step of providing a sleeve, the first vertex angle and the second vertex angle are between about 110° and about 155°.

7. The method of claim 1 wherein in the step of providing a sleeve, the first vertex angle and the second vertex angle are between about 115° and about 150°.

8. The method of claim 1 wherein in the step of providing a sleeve, the first vertex angle and the second vertex angle are between about 120° and about 145°.

9. The method of claim 1 wherein in the step of providing a sleeve, the first vertex angle and the second vertex angle are between about 125° and about 140°.

10. The method of claim 1 wherein in the step of providing a sleeve, the first vertex angle and the second vertex angle are between about 130° and about 135°.

11. The method of claim 1 wherein in the step of providing a sleeve, the terminal vertex angle is between about 35° and about 155°.

12. The method of claim 1 wherein in the step of providing a sleeve, the terminal vertex angle is between about 40° and about 150°.

13. The method of claim 1 wherein in the step of providing a sleeve, the terminal vertex angle is between about 45° and about 145°.

14. The method of claim 1 wherein in the step of providing a sleeve, the terminal vertex angle is between about 55° and about 130°.

15. The method of claim 1 wherein in the step of providing a sleeve, the terminal vertex angle is between about 60° and about 120°.

16. The method of claim 1 wherein in the step of providing a sleeve, the terminal vertex angle is between about 70° and about 110°.

17. The method of claim 1 wherein in the step of providing a sleeve, the terminal vertex angle is between about 80° and about 105°.

18. The method of claim 1 wherein in the step of providing a sleeve, the terminal vertex angle is between about 85° and about 100°.

19. The method of claim 1 wherein in the step of providing a sleeve, the terminal vertex angle is between about 90° and about 95°.

20. A method of covering a pot or floral grouping, comprising:

providing a sleeve initially constructed in a flattened condition, the sleeve comprising:

a body having an upper end, a triangular lower end, a first sidewall edge, a second sidewall edge, and an inner space and further comprising a lower portion and an upper portion extending from the lower portion, the upper portion detachable from the lower portion via a detaching element, the sleeve in the flattened condition having a terminal vertex in the triangular lower end at a junction of the first sidewall edge and the second sidewall edge, and the terminal vertex having a terminal vertex angle which faces inwardly and has an angular dimension greater than about 30° and less than about 160°, and a portion of the first sidewall edge having a first vertex, the first vertex having a first vertex angle which faces inwardly and has an angular dimension greater than about 100° and less than about 165°, and a portion of the second sidewall edge having a second vertex, the second vertex having a second vertex angle which faces the first vertex angle and has an angular dimension greater than about 100° and less than about 165°, and wherein a lower segment of the first sidewall edge, a lower segment of the second sidewall edge, the first vertex, the second vertex, and the terminal vertex cooperate to define the triangular lower end, and the body of the sleeve having a generally tapered shape when in an opened condition and the triangular lower end having an openable gusset therein;

opening the sleeve to expose the inner space of the body; and disposing a pot or floral grouping into the inner space.

21. The method of claim 20 wherein in the step of providing a sleeve, the first vertex angle and the second vertex angle are between about 105° and about 160°.

22. The method of claim 20 wherein in the step of providing a sleeve, the first vertex angle and the second vertex angle are between about 110° and about 155°.

23. The method of claim 20 wherein in the step of providing a sleeve, the first vertex angle and the second vertex angle are between about 115° and about 150°.

24. The method of claim 20 wherein in the step of providing a sleeve, the first vertex angle and the second vertex angle are between about 120° and about 145°.

25. The method of claim 20 wherein in the step of providing a sleeve, the first vertex angle and the second vertex angle are between about 125° and about 140°.

26. The method of claim 20 wherein in the step of providing a sleeve, the first vertex angle and the second vertex angle are between about 130° and about 135°.

27. The method of claim 20 wherein in the step of providing a sleeve, the terminal vertex angle is between about 35° and about 155°.

28. The method of claim 20 wherein in the step of providing a sleeve, the terminal vertex angle is between about 40° and about 150°.

29. The method of claim 20 wherein in the step of providing a sleeve, the terminal vertex angle is between about 45° and about 145°.

30. The method of claim 20 wherein in the step of providing a sleeve, the terminal vertex angle is between about 55° and about 130°.

31. The method of claim 20 wherein in the step of providing a sleeve, the terminal vertex angle is between about 60° and about 120°.

32. The method of claim 20 wherein in the step of providing a sleeve, the terminal vertex angle is between about 70° and about 110°.

33. The method of claim 20 wherein in the step of providing a sleeve, the terminal vertex angle is between about 80° and about 105°.

34. The method of claim 20 wherein in the step of providing a sleeve, the terminal vertex angle is between about 85° and about 100°.

35. The method of claim 20 wherein in the step of providing a sleeve, the terminal vertex angle is between about 90° and about 95°.

36. The method of claim 20 wherein in the step of providing the sleeve, the detaching element comprises perforations.

37. The method of claim 20 wherein in the step of providing the sleeve, the upper portion is sized to substantially surround an enclose the floral grouping.

38. The method of claim 20 wherein in the step of providing the sleeve, the upper portion is adapted to support the sleeve from a support assembly.

39. The method of claim 20 wherein in the step of providing the sleeve, the detaching element leaves a non-linear upper edge in the lower portion of the body when the upper portion is detached from the lower portion.

40. The method of claim 20 wherein in the step of providing the sleeve, the detaching element leaves a linear upper edge in the lower portion when the upper portion is detached from the lower portion.

* * * * *